US010966517B2

(12) United States Patent
Raborn

(10) Patent No.: US 10,966,517 B2
(45) Date of Patent: Apr. 6, 2021

(54) HYGIENIC DENTAL APPLIANCE CLEANER AND METHOD OF USING SAME

(71) Applicant: StarBorn Solutions, LLC, Bellaire, TX (US)

(72) Inventor: Barry Walter Raborn, Bellaire, TX (US)

(73) Assignee: STARBORN SOLUTIONS, LLC, Bellaire, TX (US)

( * ) Notice: Subject to any disclaimer, the term of this patent is extended or adjusted under 35 U.S.C. 154(b) by 0 days.

(21) Appl. No.: 16/439,195

(22) Filed: Jun. 12, 2019

(65) Prior Publication Data

US 2019/0380483 A1 Dec. 19, 2019

Related U.S. Application Data

(60) Provisional application No. 62/684,940, filed on Jun. 14, 2018.

(51) Int. Cl.

| | |
|---|---|
| ***A46B 17/06*** | (2006.01) |
| ***B08B 3/02*** | (2006.01) |
| ***B08B 3/10*** | (2006.01) |
| ***B08B 5/02*** | (2006.01) |
| ***B08B 7/00*** | (2006.01) |

(52) U.S. Cl.

CPC ..... *A46B 17/06* (2013.01); *B08B 3/02* (2013.01); *B08B 3/10* (2013.01); *B08B 5/02* (2013.01); *B08B 7/0057* (2013.01); *A46B 2200/1066* (2013.01)

(58) Field of Classification Search

None

See application file for complete search history.

(56) References Cited

U.S. PATENT DOCUMENTS

| | | | |
|---|---|---|---|
| 4,845,859 | A | 7/1989 | Evans |
| 6,171,559 | B1 | 1/2001 | Sanders |
| 8,458,922 | B2 | 6/2013 | Parisi |
| 2008/0060671 | A1 | 3/2008 | Ruffin |

FOREIGN PATENT DOCUMENTS

| | | | |
|---|---|---|---|
| CN | 203075254 | U | 7/2013 |
| CN | 203177600 | U | 9/2013 |
| CN | 204273620 | U | 4/2015 |
| JP | 2011189039 | A | 9/2011 |

*Primary Examiner* — Eric W Golightly

(74) *Attorney, Agent, or Firm* — Nolte Lackenbach Siegel

(57) ABSTRACT

A hygienic cleaner for cleaning a dental appliance. The hygienic cleaner includes a housing, a cleaning chamber, and a blower. The housing includes a base and a lid. The lid is positionable about an inlet to the base. An outlet is defined between the lid and the base. The cleaning chamber shaped to receive the dental appliance therein. The cleaning chamber is in fluid communication with the outlet. The blower includes a fan to blow air and a stator with curved blades to swirl the air through the cleaning chamber and out the outlet whereby moisture on the dental appliance is blown out of the housing. A mister may also be provided and includes a sprayer and a reservoir positionable about the cleaning chamber to emit a cleaning fluid onto the dental appliance in the cleaning chamber whereby contaminants on the dental appliance are destroyed.

17 Claims, 12 Drawing Sheets

112
4.000

112
2.250
Φ3.500

112
1.620
1.320
.645
.125
.938

836a
840a
840b 840b
836a
840a

838b 836a
430d
838a
838c
110a5
112
836b

HYGIENIC DENTAL APPLIANCE CLEANER AND METHOD OF USING SAME

CROSS-REFERENCE TO RELATED APPLICATION

This application claims the benefit of U.S. Provisional Application No. 62/684,940 filed on Jun. 14, 2018, the entire contents of which are hereby incorporated by reference herein.

BACKGROUND

The present disclosure relates generally to cleaning technology. More specifically, the present disclosure relates to techniques for cleaning dental appliances.

Various dental appliances are used to perform oral functions. For example, toothbrushes, toothpicks, and water picks are used to clean teeth and gums. In another example, dentures, bridges, retainers, aligners, and mouth guards may be placed in the mouth to support, align, or replace teeth. Such dental appliances are exposed to germs before, during, and after placement in the mouth. For example, such dental devices are often used at sinks in bathroom facilities in areas that may be exposed to contaminants, such as spray emanating from toilets in the bathroom. After use, part or all of the dental appliances may be left out, or stored in open containers, in closed containers, or in cleaning devices.

Various techniques have been used to clean the dental appliances. For example, users may rinse the items in tap water prior to re-use. Some devices have been developed to clean the dental appliances. Examples of cleaning devices are provided in U.S. Pat. Nos. 4,845,859, 6,171,559, 8,548,922, US2008/0060671, JP2011-189039A, CN203075254U, CN203177600U, and CN204273620U, the entire contents of which are hereby incorporated by reference herein to the extent not inconsistent with the present disclosure.

Despite advancements in the dental technology, there remains a need for providing devices capable of effectively cleaning dental appliances. The present disclosure is intended to provide a solution for such a need.

SUMMARY

In at least one aspect, the disclosure relates to a hygienic cleaner for cleaning a dental appliance. The hygienic cleaner comprises a housing, a cleaning chamber, and a blower. The housing comprises a base and a lid. The lid is positionable about an inlet to the base. An outlet is defined between the lid and the base. The cleaning chamber is positioned in the housing, and is shaped to receive the dental appliance therein. The cleaning chamber is in fluid communication with the outlet. The blower comprises a fan to blow air and a stator with curved blades to swirl the air through the cleaning chamber and out the outlet whereby moisture on the dental appliance is blown out of the housing.

The hygienic cleaner may have various features in various embodiments. In some embodiments, the hygienic cleaner further comprises a perforated vent positionable in the lid and connected to an upper end of the cleaning chamber. A one-way flow path is defined from the blower through the cleaning chamber, through the perforated vent, and out the outlet. The cleaning chamber comprises a perforated vent, a ring, a tube, and an end. The tube is connected to an upper end of the housing by the ring and to a bottom of the housing by the end. The housing comprises side portions and a bottom. The blower is supported on the bottom and extends into a lower end of the cleaning chamber. The hygienic cleaner may further comprise in some embodiments a mister comprising a sprayer and a cleaning fluid. The sprayer is positioned about the cleaning chamber to spray the cleaning fluid onto the dental appliance. The sprayer comprises an atomizer and/or an aerosol. The hygienic cleaner may also further comprise in some embodiments a UV light positionable about the cleaning chamber. The UV light is positioned to emit UV rays onto the dental appliance. The hygienic cleaner may further comprises a support arm to support the dental appliance in the cleaning chamber, a filter for filtering the air to be blown by the blower, a drawer positioned about the base to collect drainage from the cleaning chamber, and/or electronics to selectively operate one of the blower, a mister, and combinations thereof. The electronics comprise at least one power supply, sensor, database, transceiver, and/or clock.

In another aspect, the disclosure relates to a hygienic cleaner for cleaning a dental appliance. The hygienic cleaner comprises a housing, a cleaning chamber, a blower, and a mister. The housing comprises a base and a lid. The lid is positionable about an inlet to the base. The cleaning chamber comprises a tube positioned in the base and a perforated vent connected to the tube. The tube is shaped to receive the dental appliance therein. The perforated vent extends into in the lid to define an outlet between the lid and the perforated vent. The blower comprises a fan to blow air through the tube, through the perforated vent, and out the outlet whereby moisture on the dental appliance is blown out of the housing. The mister comprises a sprayer positionable about the cleaning chamber to emit a cleaning fluid onto the dental appliance in the cleaning chamber whereby contaminants on the dental appliance are destroyed.

The hygienic cleaner may have various features. The blower further comprises a stator with curved blades to swirl the air as it passes through the tube.

Finally, in another aspect, the disclosure relates to a method of cleaning a dental appliance. The method comprises supporting a dental appliance in a cleaning chamber within a housing, disposing a lid about an opening to the housing such that an outlet is defined between the lid and the cleaning chamber, and removing moisture from the dental appliance by blowing air in a one-way direction while swirling the air through the cleaning chamber and out the outlet.

The method may have various options. The method further comprises disinfecting the dental appliance by spraying a cleaning fluid about the dental appliance and/or defining a timing sequence for performing portions of the method.

This summary provides some example features and is not intended to be limiting.

BRIEF DESCRIPTION OF THE DRAWINGS

So that the features herein can be understood in detail, a more particular description may be had by reference to the embodiments thereof that are illustrated in the appended drawings. It is to be noted, however, that the examples illustrated are not to be considered limiting of its scope. The figures are not necessarily to scale and certain features and certain views of the figures may be shown exaggerated in scale or in schematic in the interest of clarity and conciseness.

DETAILED DESCRIPTION

In the following description, numerous details are set forth to provide an understanding of the present disclosure. However, it will be understood by those skilled in the art that the present disclosure may be practiced without these details and that numerous variations or modifications from the described embodiments are possible.

The disclosure relates to a hygienic cleaner for protecting and/or cleaning dental appliances, even in contaminated environments, such as bathrooms. The hygienic cleaner provides a housing with a base and a lid. A cleaning chamber is positioned in the housing to support the dental appliance therein. The hygienic cleaner also includes a blower to dry the dental appliance by swirling gas (e.g., air) through the cleaning chamber and out an outlet located about the lid. The hygienic cleaner uses air flow (e.g., one-way, swirling, helical, etc.) of the air through the housing to dry the dental appliance, thereby removing moisture which can grow germs, bacteria, viruses, dirt, mold, biohazards, and/or other contaminants which may pose a health threat to users.

The hygienic cleaner may also include a mister to apply a liquid, such a cleaning fluid (e.g., cleaner, disinfectant, sanitizer, germ killer, medications, flavoring, mouthwash, peroxide, etc.) to the dental appliance. The mister may spray atomized and/or aerosolized cleaning fluids onto the dental appliance for cleaning and/or disinfecting the dental appliance. Other devices, such as an ultra-violet ("UV") light, a removable drainage drawer, an air filter, and electronics may also be provided.

The hygienic cleaner is intended to provide one or more of the following, among others: isolation and/or protection of dental equipment, blow drying of the dental appliance, one-way air flow through the housing and/or over the dental appliance, application of cleaning fluid to the dental appliance, one-way outlet for exiting contaminants and/or moist air from the housing, a protective lid, a vent to release air flow, electronic control capabilities, dishwasher safe components, etc.

Figure 1:
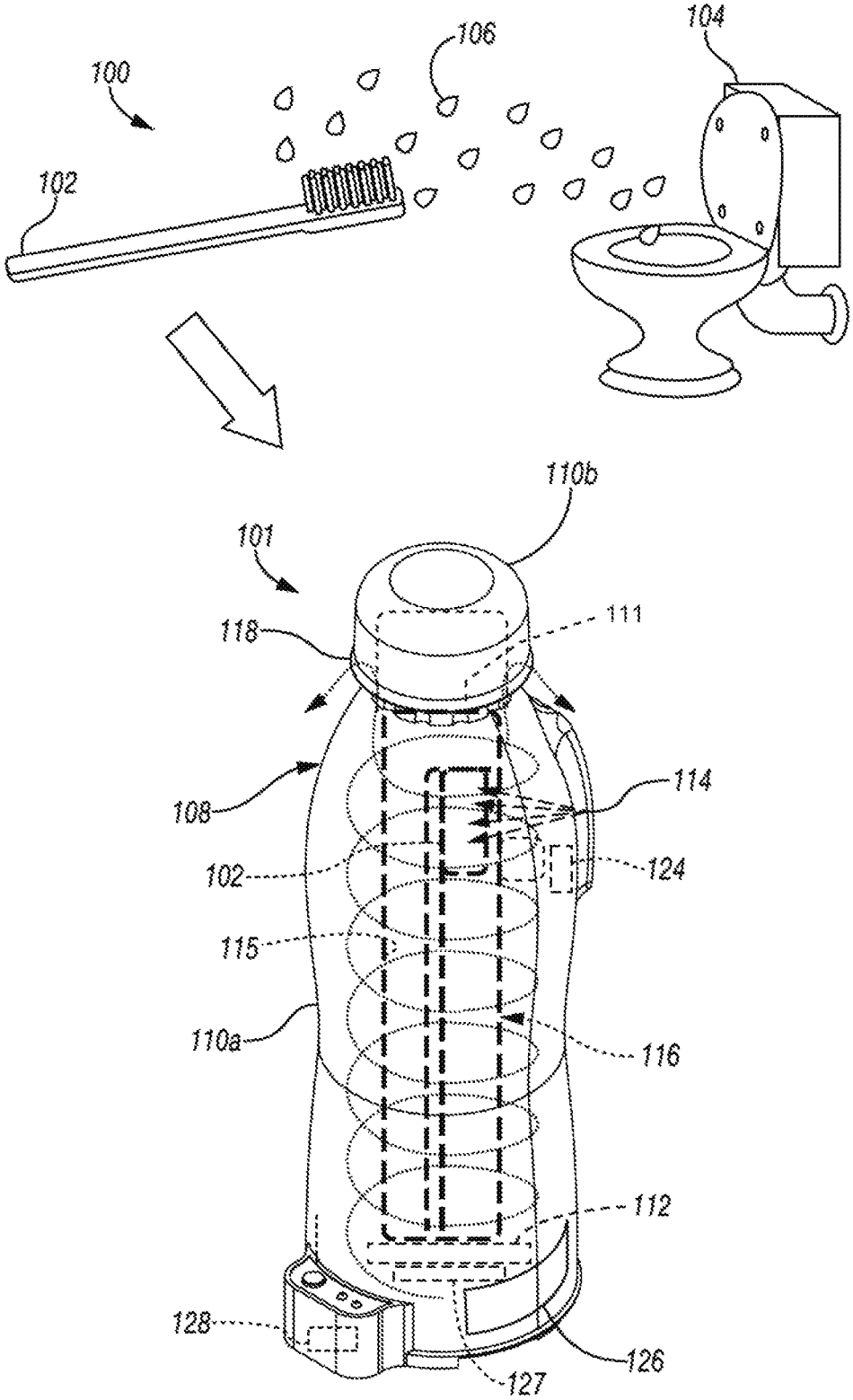
FIG. 1 is a schematic diagram depicting a dental appliance in a contaminated environment, and a hygienic cleaner for cleaning the dental appliance.
Figure 2:
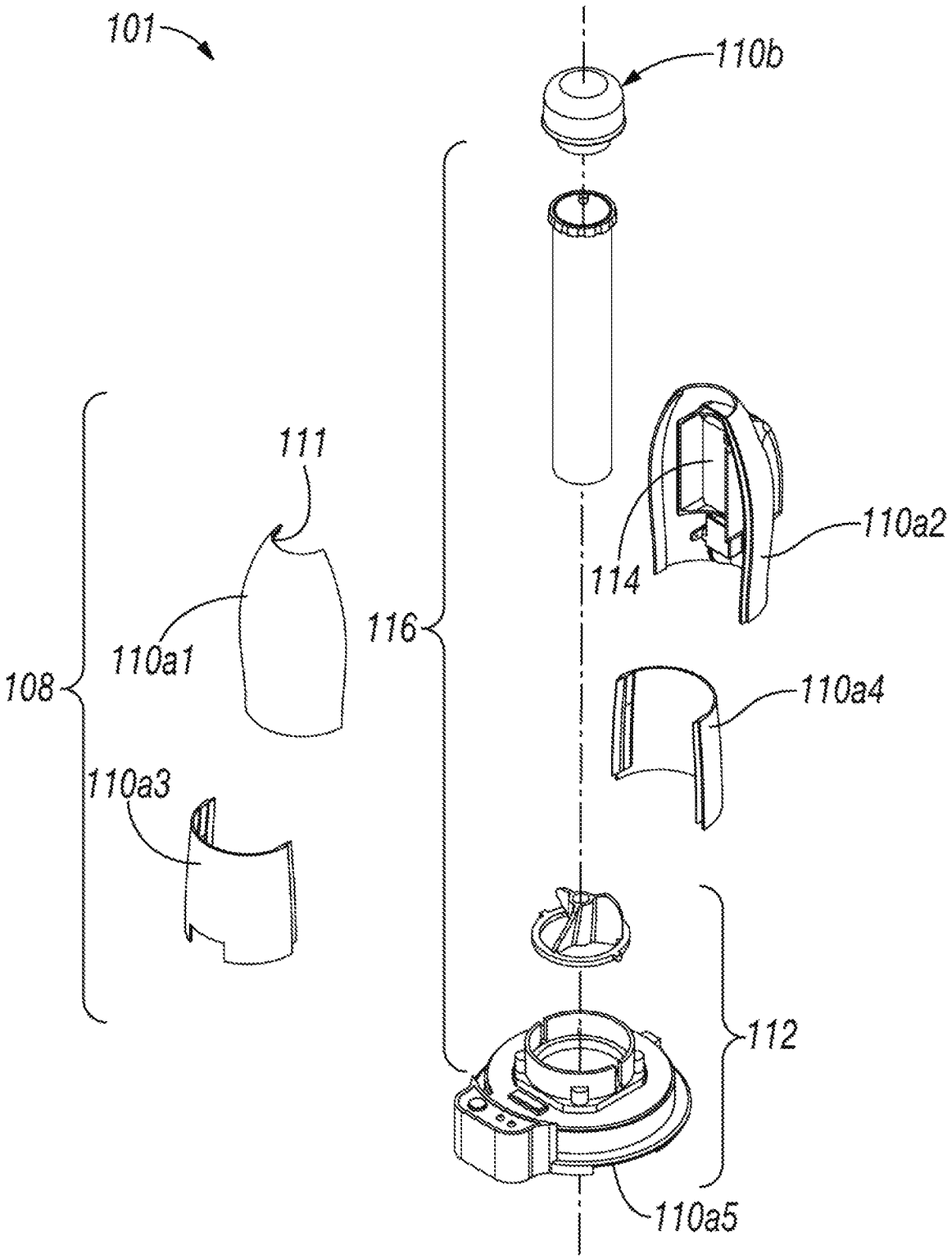
FIG. 2 is an exploded view of the hygienic cleaner.
Figure 3A:
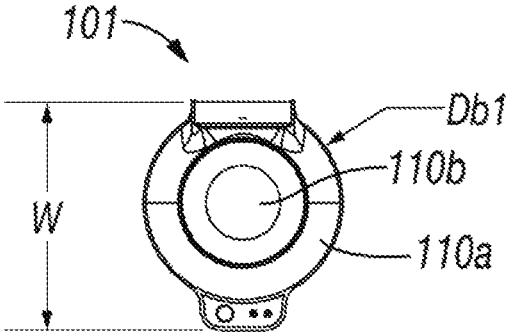
FIGS. 3A-3D are top, rear, front, and bottom views, respectively, of the hygienic cleaner.
Figure 3B:
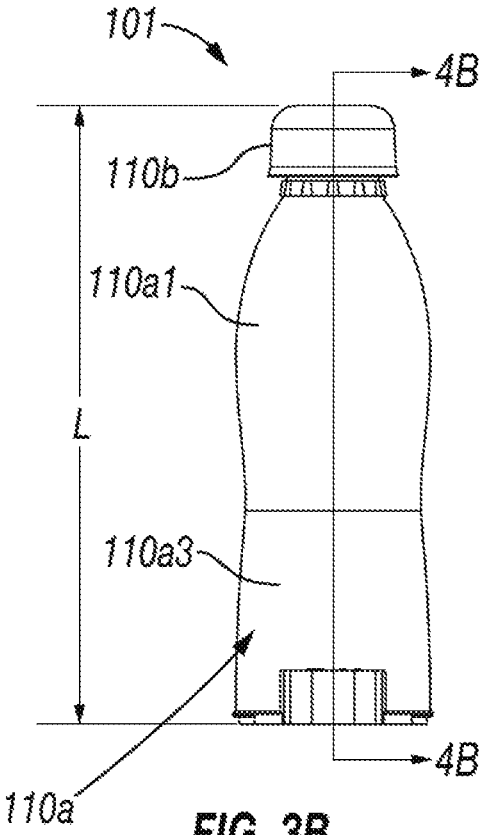
Figure 3C:
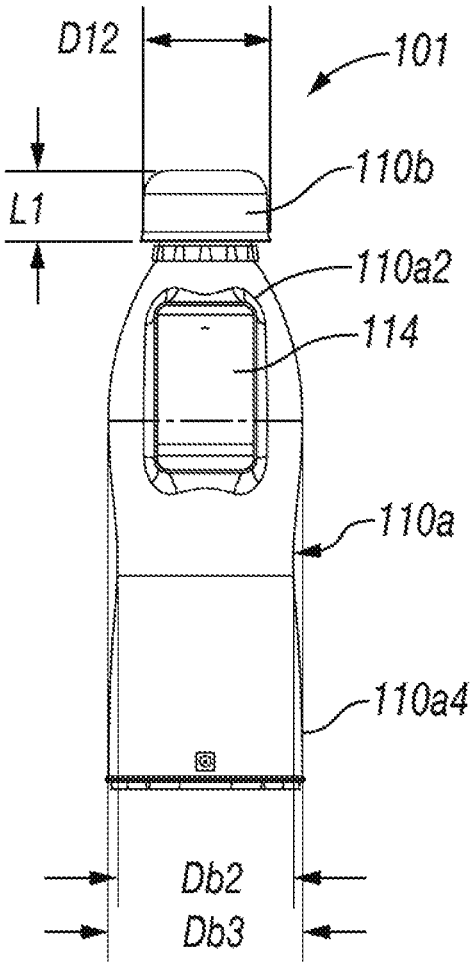
Figure 3D:
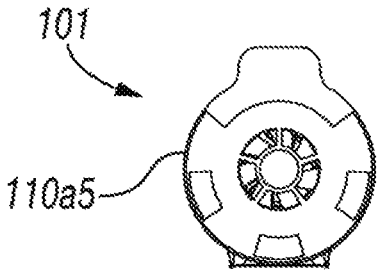

FIG. 1 depicts an example environment 100 in which the hygienic cleaner 101 may be used for cleaning a dental appliance 102. The dental appliance 102 is shown both outside of the hygienic cleaner 101 and in hidden lines within the hygienic cleaner 101. In this example, the dental appliance 102 is a toothbrush, but any dental appliance may be used. As described further herein, the dental appliance 102 may be, for example, a retainer, denture, aligner, bridge, mouth guard, etc.

As shown in this view, the hygienic cleaner 101 and the dental appliance 102 are used in or near a contaminated environment, such as a bathroom featuring a toilet 104. As indicated by droplets exiting the toilet, the toilet may generate contamination 106 in an area proximate to the dental appliance 102, thereby contaminating the dental appliance 102. The dental appliance 102 may be exposed to other contamination (e.g., germs, bacteria, viruses, dirt, mold, biohazards, etc.) in/on the air, surfaces, users, various environments, and/or other sources. The hygienic cleaner 101 is shaped to protect the dental appliance 102 from the contaminated example environment 100 and/or to treat the dental appliance 102 to remove contaminants therefrom.

As shown in FIGS. 1, 2, and 3A-3D, the hygienic cleaner 101 includes a housing 108, a blower 112, and, in the illustrated embodiment, a mister 114. The mister 114 may be omitted in some embodiments. The housing 108 has a base 110*a* positionable on a surface and a lid 110*b* positionable about an inlet 111 of the base 110*a*. A cleaning chamber 116 is accessible through the inlet and is positionable in the base 110*a*. The cleaning chamber 116 has a cleaning cavity 115 to receive and isolate the dental appliance 102 therein.

As shown in each of these figures, the base 110*a* may include one or more portions, which may differ in size, shape, and number from that illustrated. As shown, the portions include upper sides 110*a*1,*a*2, lower sides 110*a*3, *a*4, and bottom 110*a*5. The upper sides 110*a*1,*a*2 are opposing upper halves of the base 110*a*. Lower sides 110*a*3,*a*4 are opposing lower halves of the base 110. The upper and lower sides 110*a*1-*a*4 unite to form a tubular portion of the base 110*a*. The upper sides 110*a*1,*a*2 define the inlet 111 to the housing 108 at an upper end thereof. Bottom 110*e* is positioned at a lower end 109 of the lower sides 110*a*3,*a*4 to close a bottom of the base 110*a*.

The lid 110*b* is positionable about the inlet 111 to the base 110*a*. An air outlet 118 is defined between the lid 110*b* and the base 110*a*. The blower 112 swirls air (and/or other fluids) through the housing 108 and out the outlet 118 as indicated by the swirling dashed line in FIG. 1. The air flows through the housing 108 and out the outlet 118 along a one-way flow path as is described further herein. The mister 114 is positioned about the base 110*a* to spray a fluid (e.g., a cleaner, antiseptic, anti-bacterial, fluoride, mint, or other fluid) onto the dental appliance 102 as is also described further herein.

The hygienic cleaner 101 may also be provided with additional features in some embodiments, such as a UV light 124 for applying UV rays to the dental appliance, a removable drainage drawer 126 to collect drainage about the bottom of the base 110*a*, a filter 127 positionable about the blower 112 to filter air entering the cleaning chamber 116, and various electronics 128 to operate the dental appliance 102 and its components. These and other features and configurations may be provided as described more fully herein.

Figures 4A, 4B, 4C:
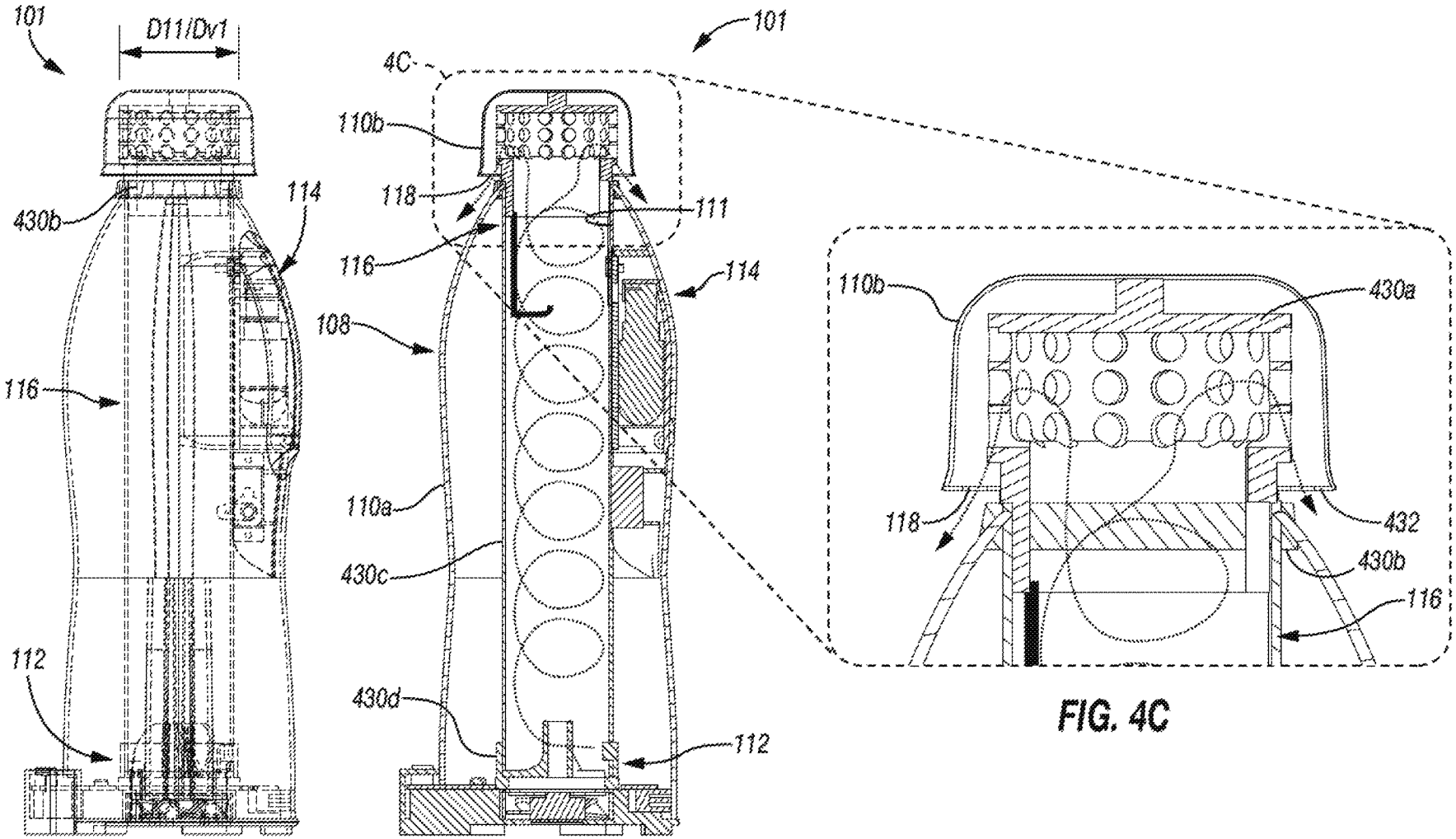
FIG. 4A is a side view of the hygienic cleaner shown with hidden lines.
FIG. 4B is a longitudinal cross-sectional view of the hygienic cleaner of FIG. 3B taken along line 4B-4B.
FIG. 4C is a detail view of a portion 4C of the hygienic cleaner of FIG. 4B.

FIGS. 4A-4C show additional views of the hygienic cleaner 101. FIGS. 4A and 4B show hidden line and cross-sectional views, respectively, depicting detailed aspects of the hygienic cleaner 101. FIG. 4C shows a detailed view of an upper portion of the hygienic cleaner 101. These figures show example configurations of the cleaning chamber 116, the blower 112, and the mister 114. These components are positioned in the housing 108 for cleaning, treating and/or isolating the dental appliance 102 (as shown in FIG. 1).

As shown in the examples of FIGS. 4A-4C, the base 110*a* and the lid 110*b* of the housing 108 each are shaped to receive portions of the cleaning chamber 116 therein. A lower end of the cleaning chamber 116 is supported in a bottom of the base 110*a*. An upper end of the cleaning chamber 116 extends through the inlet 111 and is supported in the lid 110*b*. The lid 110*b* is supported about the inlet 111 of the base 110*a* by the cleaning chamber 116.

As shown in FIGS. 4A-4C and 5, the cleaning chamber 116 includes a vent 430*a*, a ring 430*b*, a container (or tube or cylinder) 430*c*, and an end 430*d*. The vent 430*a* is positioned in the lid 110*b* and the end 430*d* is positioned along the bottom 110*a*5 of the base 110*a* (see, e.g., FIG. 2). The container 430*c* extends between the vent 430*a* and the end 430*d*. The container 430*c* is shaped to receive the dental appliance 102 therein (as shown in FIG. 1).

The ring 430*b* is positioned about an upper end of the container 430*c* and an upper end of the base 110*a*. The ring 430*b* may secure the vent 430*a* to the container 430*c* and to the upper end of the base 110*a*. The ring 430*b* may have an interference fit, threads, snap fit, and/or other means for securing the ring 430*b* to the container 430*c* and/or the base 110*a*.

Figure 5:
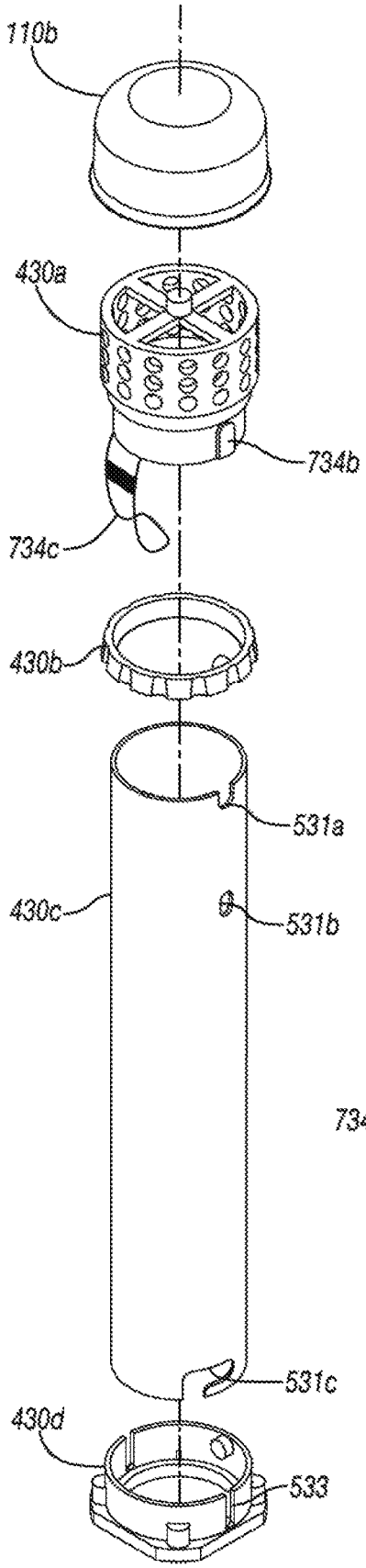
FIG. 5 is an exploded view of a cleaning chamber of the hygienic cleaner.
Figure 6A:
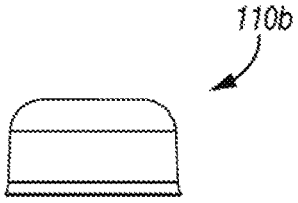
FIGS. 6A and 6B are side and bottom views, respectively, of a lid of the hygienic cleaner.
Figure 6B:
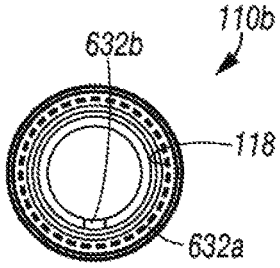
Figure 7A:
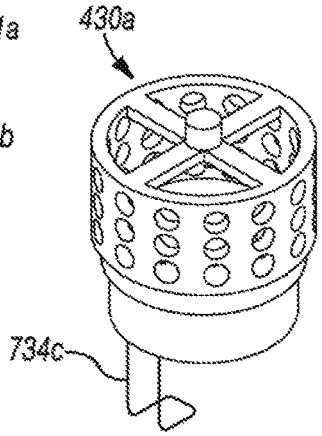
FIGS. 7A-7D are perspective, side, bottom, and top views, respectively, of a perforated vent of the hygienic cleaner.
Figure 7B:
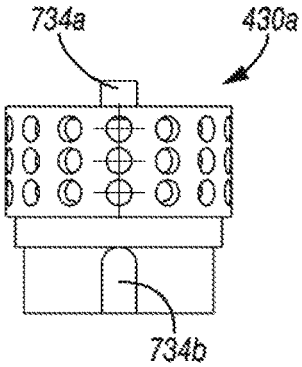
Figure 7C:
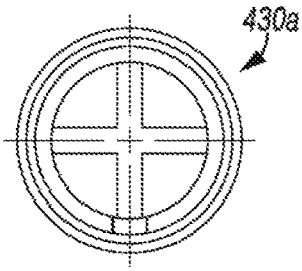
Figure 7D:
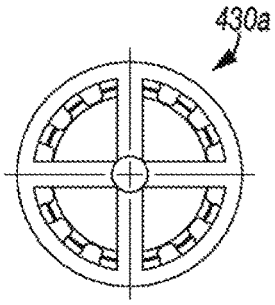

As shown in FIG. 5, the container 430*c* has a keyway 531*a* at an upper end thereof, a mist hole 531*b* below the keyway 531*a*, and a groove 531*c* along a bottom end thereof. The groove 531*c* is shaped to slidingly receive a notch 533 on the end 430*d* to secure the container 430*c* to the end 430*d*. The keyway 531*a* and the mist hole 531*b* are positioned along the container 430*c* for cooperative engagement with the vent 430*a* and the mister 114, respectively, as is described further herein.

The container 430*c* is shaped to receive the dental appliance 102 (as shown in FIG. 1). In this example, the container 430*c* has a cylindrical or tubular shape to receive a toothbrush therein. However, the container 430*c* may have a variety of sizes and shapes corresponding to various dental appliances.

As shown in FIGS. 4A-4C and 6A-6B, the lid 110*b* may have a mushroom shaped body with an inner cavity shaped to receive an upper end of the cleaning chamber 116. The lid 110*b* may have an inner surface with an inner diameter Dl1 corresponding to an outer diameter Dv1 of the vent and shaped to receivingly engage an outer surface of the vent 430*a*. The lid 110*b* may also have an outer diameter Dl2 (FIG. 3) larger than the outer diameter Dv1 of the vent 430*a* to define an air flow passage therebetween.

The lid 110*b* may have a lip 632*a* along a bottom surface thereof extending inward to define the inner diameter Dl1. The lip 632*a* may have the outlet 118 therethrough shaped for the release of the air flow therethrough as indicated by the dashed arrows. The outlet 118 may be positioned between the lid 110*b* and the cleaning chamber 116 and/or between the lid 110*b* and an upper end of the base 110*a*. The outlet 118 may be perforations along the lip 632*a*, one or more gaps between the lid 110*b* and the base 110*a*, and/or one or more gaps between the lid 110*b* and the cleaning chamber 116 (or vent 430*a*). The lid may also have a notch 632*b* for engagement with the vent 430*a*.

As shown in FIGS. 4A-4C and 7A-7D, the vent 430*a* is a cylindrical member receivable in the lid 110*b*. An upper portion of the vent 430*a* has perforations therethrough. The perforations are in fluid communication with the container 430*c* and the outlet 118 for passing the air flow therethrough as indicated by the dashed arrows of FIG. 4C. A top of the vent 430*a* may be open with support bars extending across. A tip 734*a* may be positioned on a top end of the vent 430*a* along the support bars. The tip 734*a* may extend above the vent 430*a* for engagement with the lid to define a space therebetween for air flow.

A lower end of the vent 430*a* is receivable into an upper end of the container 430*c*. The lower end of the vent 430*a* may be stepped for receiving an upper end of the container 430*c* and/or an upper end of the base 110*a* thereon. The outer diameters of the stepped container 430*c* may correspond to inner diameter of the lip 432 of the lid 110*b* and the inner diameter of the container 430*c* for sealing engagement therebetween.

The vent 430*a* may have a key 734*b* corresponding to the keyway 531*a* in the container 430*c*. The keyway 531*a* is shaped for a one-way fit between the container 430*c* and the vent 430*a*. The key 734*b* may be insertable into the keyway 531*a* in a position to prevent rotation thereof and to assure alignment of the dental appliance 102 (as shown in FIG. 1) within the container 430*c*. The key 734*b* may also engage the notch 632*b* for alignment with the lid 110*b*.

A support arm 734*c* may extend below a bottom of the vent 430*a* for insertion into the container 430*c*. The support arm 734*c* as shown is a curved member made of a flexible wire or plastic material capable of supporting the dental appliance 102 in the container 430*c*. The support arm 734*c* may have a hook-shaped body shaped to receive the dental appliance 102 such that it is suspendable therefrom. The support arm 734*c* may be removably fixed to the vent 430*a* such that, when the vent 430*a* is removed, the dental appliance 102 may be lifted out of the container 430*c* therewith. The support arm 734*c* may also be positioned for alignment of the dental appliance 102 (as shown in FIG. 1) in the container 430*c* and/or for alignment with the keyway 531*a* and/or mist hole 531*b*. The support arm 734*c* may also be positioned for supporting the dental appliance 102 a distance above the blower 112.

As shown in FIGS. 4A-4C, 8, and 9A-9C, the blower 112 includes a stator 836*a* and a motor assembly 836*b* positionable about the bottom 110*a*5. The blower 112 is configured to generate air flow through the container 430*c* and out the outlet 118 in a one-way flow (see, e.g., FIG. 1). This air flow is intended to dry the dental appliance 102 positioned in the container 430*c*, while removing contaminants from the dental appliance 102 and the container 430*c*. The drying is also intended to prevent growth of and/or promote removal of contaminants from the dental appliance 102.

The one-way flow path may also inhibit entry of contaminants into the cleaning chamber 116, thereby isolating the dental appliance from contaminants. As shown, the one-way flow may be non-linear such that the flow swirls upward through the container 430*c*, and then turns downward as it passes through the vent 430*a* and out the lid 110*b*. The shape of the vent 430*a*, lid 110*b*, and outlet 118 may be defined to provide an angle sufficient to help prevent airflow from entering back into the container 430*c*.

The motor assembly 836*b* includes a fan 838*a*, a motor plate 838*b*, and electronics 838*c*. The fan 838*a* may be a conventional electrical fan 838*a* with a motor capable of generating air flow through the cleaning chamber 116. For example, the fan 838*a* may pull air from below the base 110*a* through the fan 838*a* and the stator 836*b*. Such air flow may be linear similar to, for example, a hair dryer. The fan 838*a* may be positionable in a receptacle in the bottom 110*a*5. The fan 838*a* may be coupled to and operable with the electronics 838*c*. The motor plate 838*b* may be positioned about the fan 838*a* to secure the fan 808*a* to the bottom 110*a*5. The filter 127 (as shown in FIG. 1) may be provided about the base 110*a*5 to remove particles from air entering the fan 838*a*.

Figures 8, 9A, 9B, 9C, 10A, 10B:
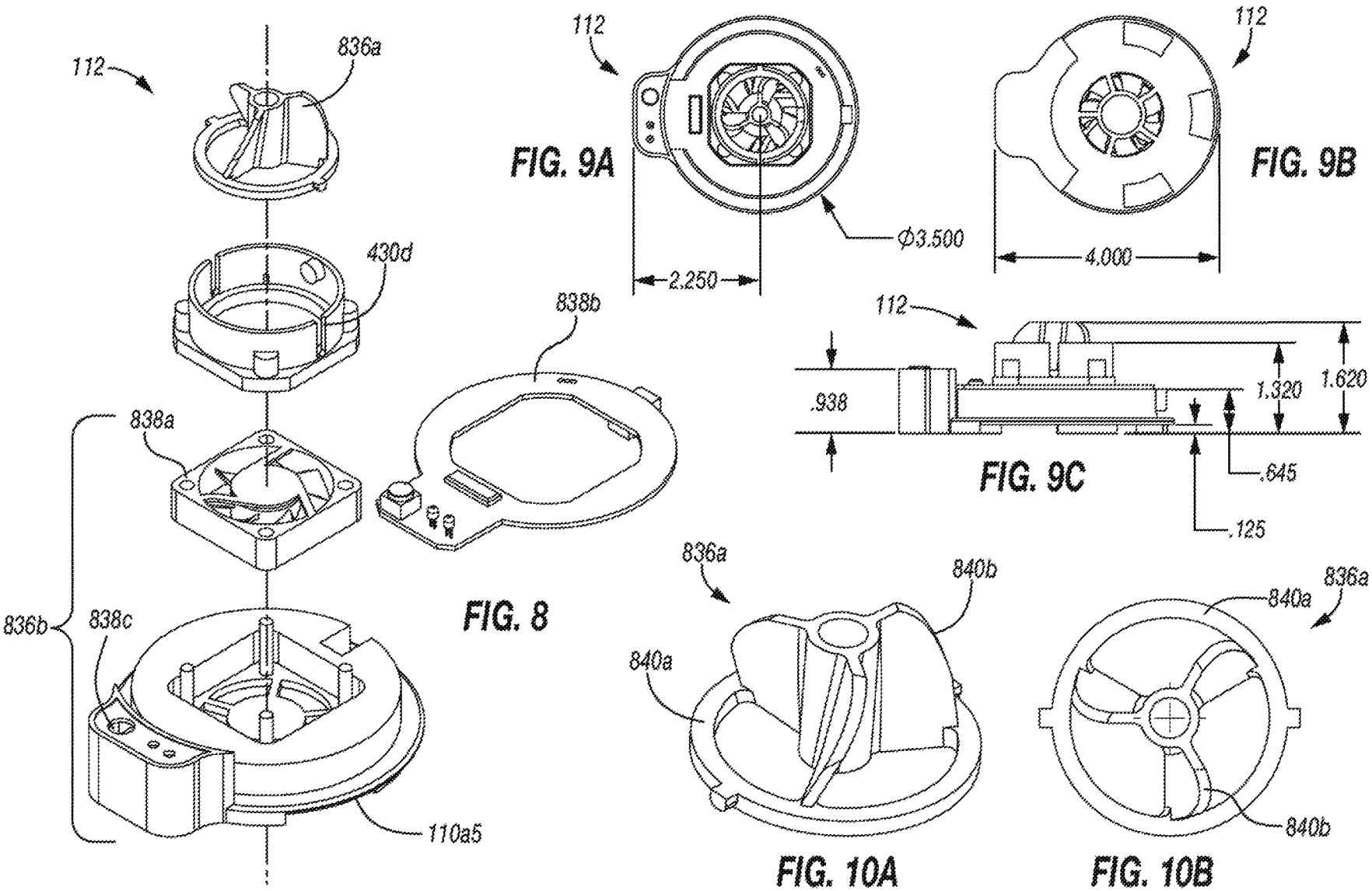
FIG. 8 is an exploded view of a blower of the hygienic cleaner.
FIGS. 9A-9C are top, bottom, and side views, respectively, of the blower.
FIGS. 10A and 10B are perspective and top views, respectively, of a stator blade of the hygienic cleaner.

As shown in FIGS. 8 and 10A-10B, the stator 836*a* may include a ring 840*a* and blades 840*b*. The ring 840*a* may be receivable in the end 430*d* above the fan 838*a*. The ring 840*a* may have tabs receivable in corresponding cutouts in the end 430*d* to prevent rotation and to assure alignment in the end 430*e*. The end 430*e* is then secured to motor plate 838*b* and/or the bottom 110*a*5.

The blades 840*b* extend above the ring 840*a* for insertion into a bottom of container 430*c*. The blades 840*b* have a curved shaped and are spaced apart to provide a passage for air flow from the fan 838*a*. The blades 840*b* are shaped to swirl the air generated by the fan 838*a* and to circulate air about the dental appliance 102 positioned in the container 430*c*, thereby drying the dental appliance 102. The shape of the blades 840*b* may be configured to take the vertical or upward flow from the fan 838*a* and turn the air to provide a swirling flow (e.g., helical, turbulent, or non-laminar flow).

This swirling flow is intended to provide drying action surrounding the dental appliance 102 and inside of the cleaning chamber 116. This flow extends along a one-way flow path from the blower 112 through the cleaning chamber 116, and out the outlet 118. This one-way flow path may be used to remove moisture and/or contaminants from the cleaning chamber 116 and/or the dental appliance 102.

Figure 11A:
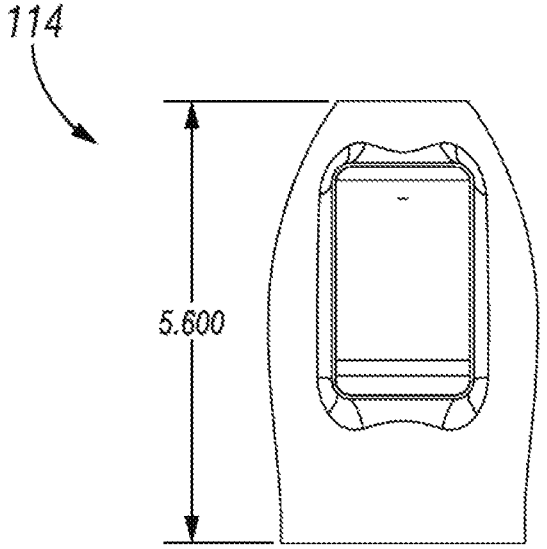
FIGS. 11A-11C are front, side, and exploded views, respectively, of a mister of the hygienic cleaner.
Figure 11B:
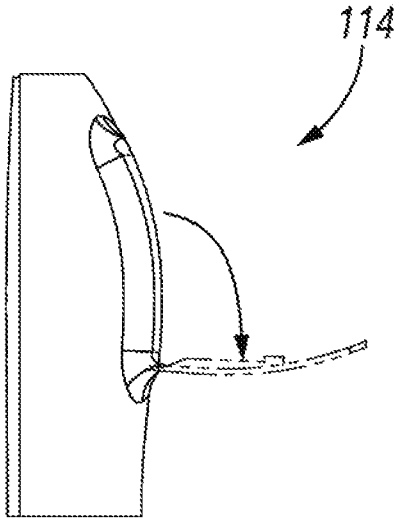
Figure 11C:
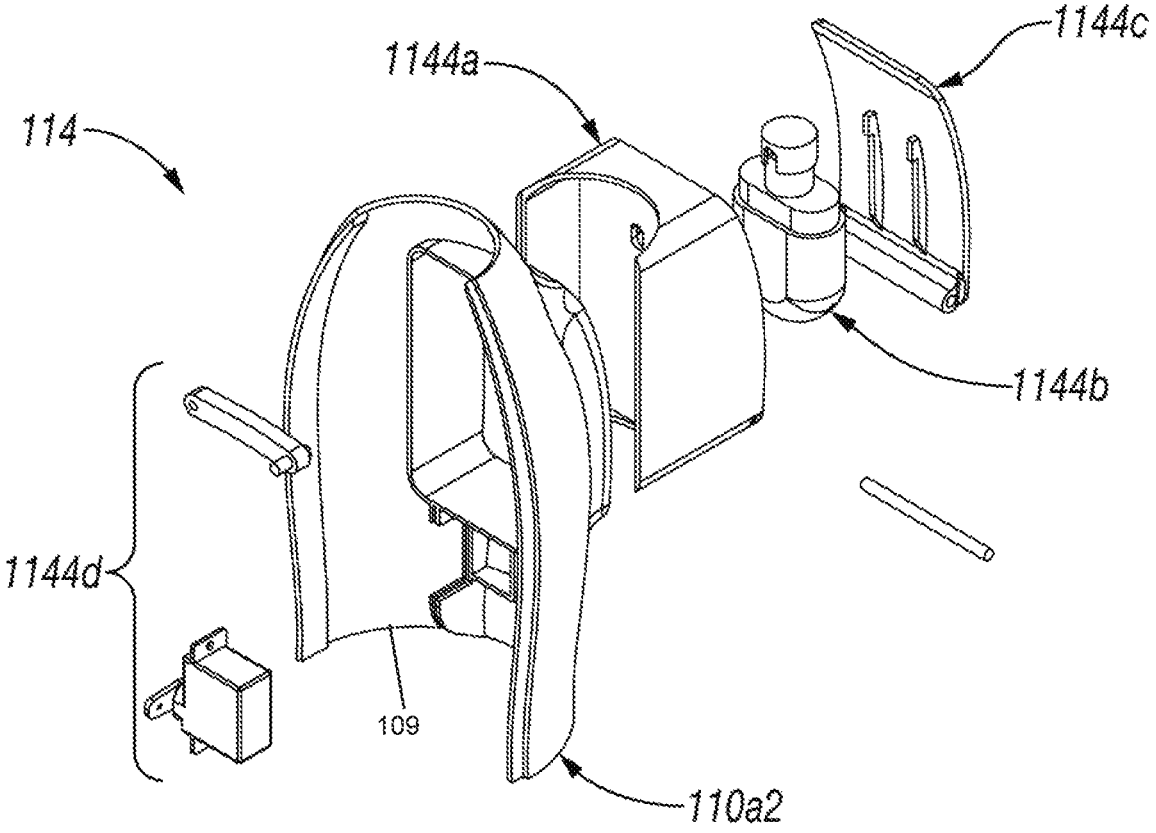

FIGS. 11A-11C show the mister 114 in greater detail. The mister 114 may be a conventional sprayer capable of emitting a spray of fluid (e.g., aerosolized droplets). In this example, the mister 114 includes a reservoir support 1144*a*, a reservoir 1144*b*, a door (or cover) 1144*c*, and a release 1144*d*. The reservoir support 1144*a* may hold parts of the mister 114 about the portion 110*a*2. The door 1144*c* may enclose the reservoir 1144*b* about the portion 110*a*2.

The reservoir 1144*b* may be a bottle of fluid (e.g., liquid), such as a cleaning fluid for cleaning, disinfecting, and/or sanitizing the dental appliance. The mist may be a dental fluid, such as a cleaner, disinfectant, sanitizer, germ killer, medication, flavoring, mouthwash, peroxide, or other material safely disposable in a user's mouth with the dental appliance 102. The door 1144*c* may be opened to access the reservoir 1144*b* as shown in FIG. 11B and closed to secure the reservoir 1144*b* about the housing 110*a*2 as shown in FIG. 11A.

The release 1144*d* may include a nozzle, pin, switch and other components for releasing the mist. The release 1144*d* may include an atomizer, e.g., an ultrasonic horn atomizer, for atomizing the mist (i.e., rendering the liquid into fine droplets) to be sprayed. The mister 114 may be activated to release the fluid from the reservoir 1144*b* by the electronics 128 (as shown in FIG. 1) and/or by manual depression of a lever of the release 1144*d*. Activation of the mister 114 may cause a burst of spray while holding the lever in the turned position may cause a continuous stream of spray.

The release 1144*d* may be aligned with the hole 531*b* of FIG. 5 to spray fluid into the container 430*c*. The dental appliance 102 may be aligned within the container 430*c* as described further herein such that, when the mister 114 is activated, the spray is directed toward the dental appliance 102 (e.g., at the bristles of the toothbrush). The flow of the air in the container 430*c* may circulate the mist over the dental appliance 102 during operation. The mist may be atomized and/or aerosolized into small droplets so that the fluid may flow out the outlet 118 with the air. The swirling action of the air by the stator 836*b* may help convey the mist around all sides of the dental appliance 102 and out the outlet 118.

Figure 11D:
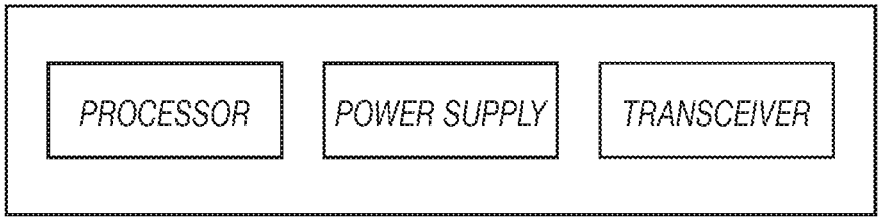
FIG. 11D is a schematic diagram of electronics of the hygienic cleaner.

FIG. 11D is a schematic diagram of the electronics 128 that may be used with the hygienic cleaner 101. As shown by this device, the hygienic cleaner 101 may be 'smart' with capabilities of automatic operation, communication, data collection, and/or other operations. For example, the electronics 128 may include a power supply (e.g., battery) to power the device, a transceiver to communicate with other devices, a sensor to monitor operation of the device, a database to collect data concerning the device and/or the user, and a processor to operate the device and/or its components.

By way of example, the mister and/or the air flow may be set on a timer or switch to provide a sequence of operation. Upon insertion of the dental appliance 102 and closing of the appliance or by manual activation, the electronics 128 may trigger the blower 112, mister 114, UV light 124, and/or other devices to operate for a period of time. The dental appliance 102 may also shut off at a given time or event.

Figure 12A:
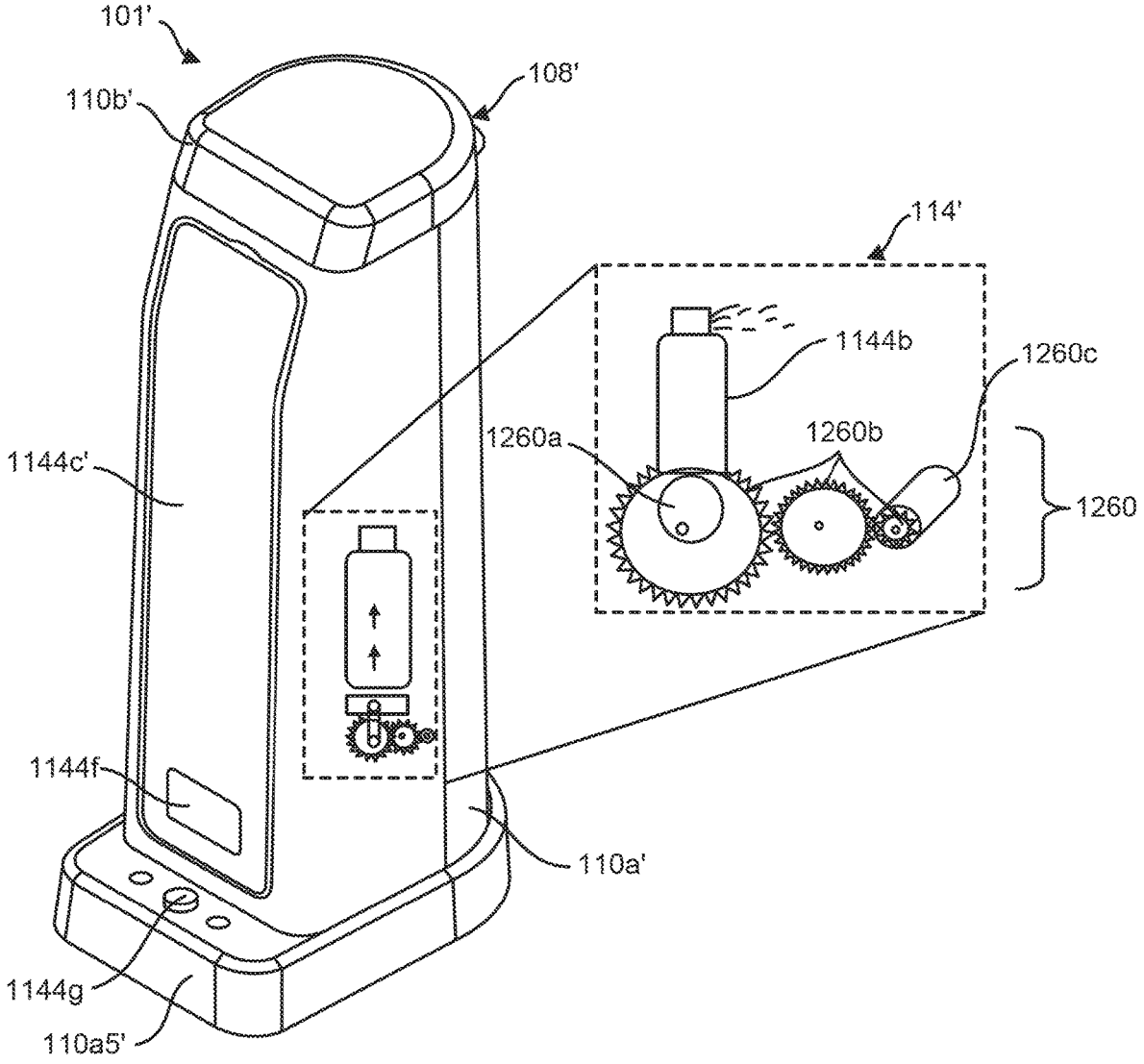
FIGS. 12A-12C are perspective (with detail), cross-sectional, and exploded views, respectively, of another version of the hygienic cleaner.
Figure 12B:
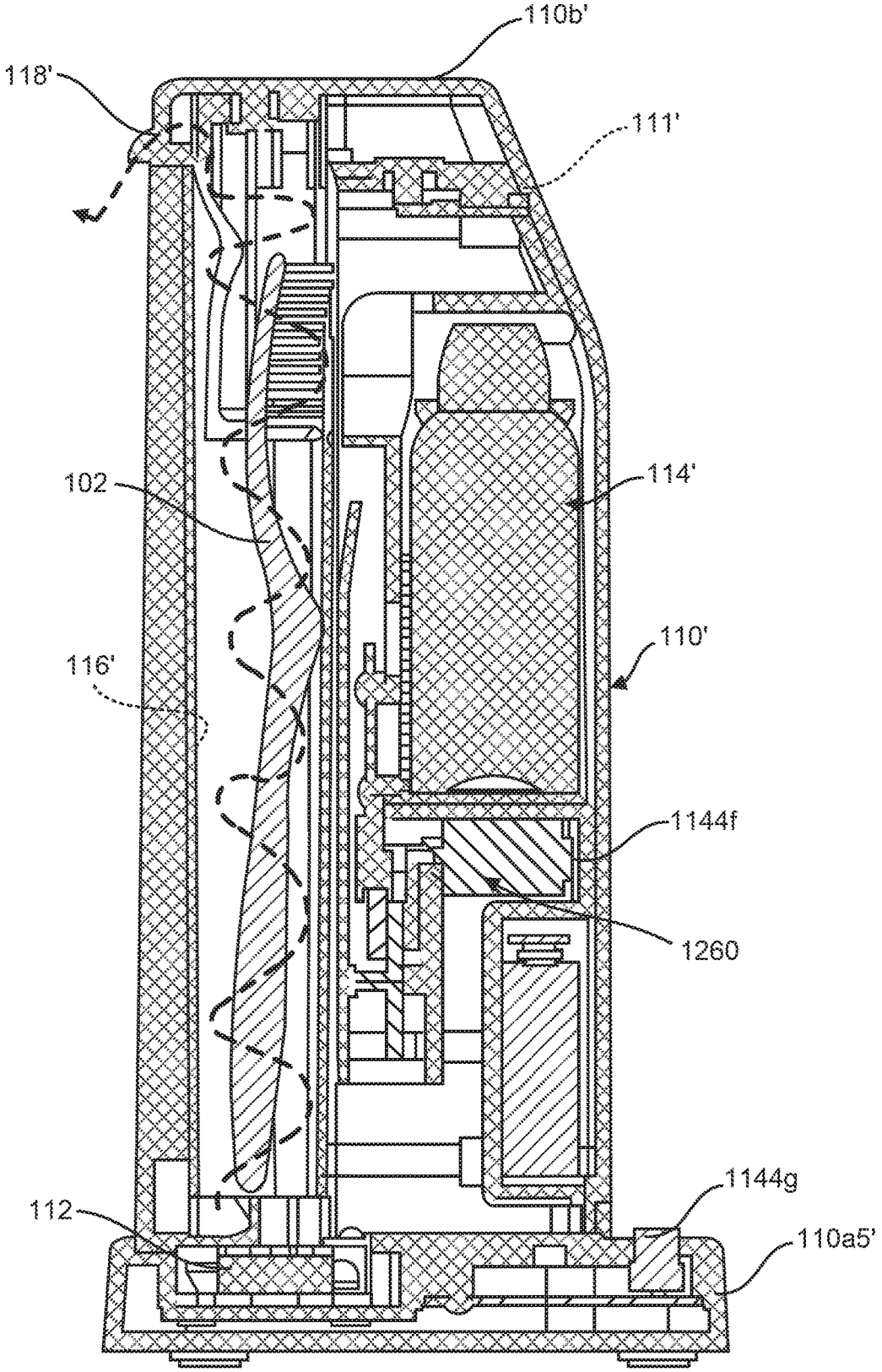
Figure 12C:
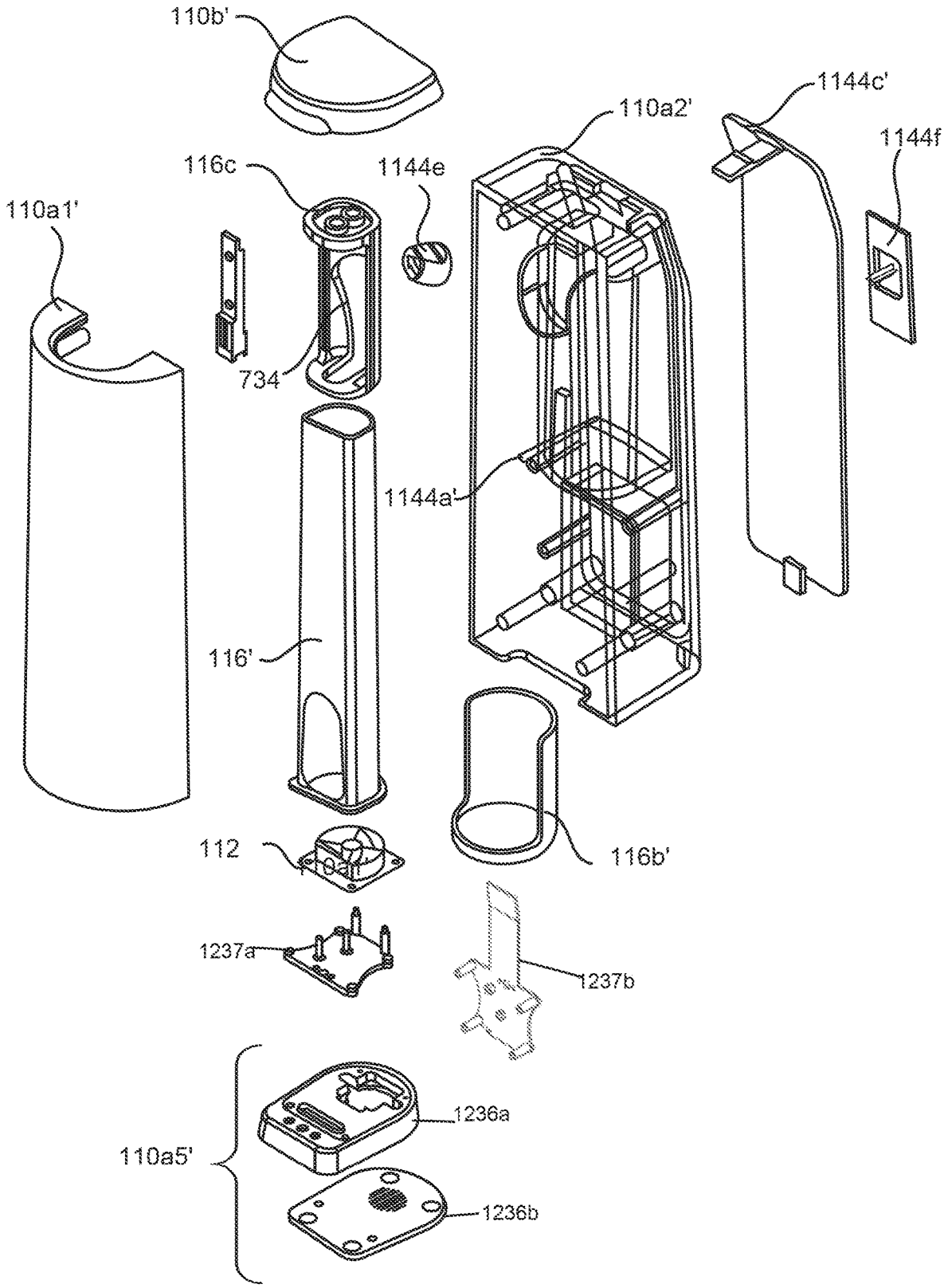

FIGS. 12A-12C show another version of the hygienic cleaner 101' for cleaning the dental appliance 102. FIGS. 12A-12C are perspective (with detail), cross-sectional, and exploded views, respectively, of another version of the hygienic cleaner 101'. This version is similar to the hygienic cleaner 101 of FIGS. 4A-11C, except that this version has a modified housing 108', a gear driven mister 114', elimination of the vent 430*a*, and some other modifications as described further herein. As shown by FIGS. 12A-12C, variations to the shape and structure of the hygienic cleaner 101, 101' may be provided.

In this version, the housing 108' has a different shape than the housing 108 in FIG. 1. The housing 108' has a base 110*a*' positionable on a surface and a lid 110*b*'. The lid 110*b*' is positionable about an inlet 111' of the base 110*a*' to define a cleaning chamber 116' therein with an air outlet 118' defined between the lid 110*b*' and the base 110*a*'. The base 110*a*' includes sides 110*a*1', 110*a*2', door 1144*c*', and bottom 110*a*5'. The sides 110*a*1', 110*a*2' combine to form a tubular shape supported on the bottom 110*a*5'. The side 110*a*1' has curved exterior, and the side 110*a*2' has a polygonal exterior with an opening therethrough. The door 1144*c*' is positioned over the opening in the side 110*a*2' to provide access to the mister 114' therein. The bottom 110*a*5' may have multiple portions that combine to form a platform to support the base 110*a*' as shown in FIG. 12C. The base 110*a*' may include various components such as a platform 1236*a* and a frame 1236*b* to support the blower 112 on a surface. Also, the side 110*a*2' may be provided with inserts 1237*a*, 1237*b* to support electronics, the reservoir, or other devices therein.

The hygienic cleaner 101' includes the blower 112 to swirl air (and/or other fluids) through the housing 108' and out the outlet 118' as indicated by the swirling dashed line. The air flows through the housing 108' and out the outlet 118 along the one-way flow path as is described further herein. The mister 114' is positioned about the side 110*a*2' to spray a fluid onto the dental appliance 102 as is also described further herein.

A cleaning chamber 116*a*' is supported in a bottom of the base 110*a*' in a receiver 116*b*'. The cleaning chamber 116*a*' is a tubular member with a lower opening positionable about the blower 112 to receive airflow therethrough, has an upper opening positionable about the lid 110*b*', and a side opening to receive mist from the mister 114'. An upper end of the cleaning chamber 116*a*' is supported about the lid 110*b*'. The lid 110*b*' is supported about the inlet 111' of the base 110*a*' adjacent the cleaning chamber 116*a*' to receive airflow passing through the cleaning chamber.

Support 116*c* is a tubular member positioned in the cleaning chamber 116*a*' to support the dental appliance 102. The support 116 is removably supported in the cleaning chamber 116*a*' and includes a support arm 734' therein to hold the dental appliance. The support 116*c* may also be supported by the lid 110*b*' and/or the side 110*a*2'.

The side 110*a*2' of the base 110*a*' is shaped to support the mister 114' therein. The mister 114' in this version includes a receptacle 1144*a*' shaped to receive and support the reservoir 1144*b*, a nozzle 1144*e* to distribute mist from the reservoir 1144*b*, and an activator (button) 1144*f* to activate the mister 114'.

The mister 114' is accessible through the door 1144*c*' and the button 1144*f* extends through the door 114*c*'. In this version, the mister 114' is activated upon depression of the button 1144*f* by a trigger assembly 1260. The mister 114' and the trigger assembly 1260 are supported in the side 110*a*2' of the base 110*a*'. The trigger assembly 1260 includes a cam 1260*a*, gears 1260*b*, and motor 1260*c*. The motor 1260*c* is coupled to the button 1144*f*, and to the gears 1260*b*. The gears 1260*b* are coupled to the mister 114' by the cam 1260*a*.

Upon depression of the button 1144*f*, the button 1144*f* activates the motor 1260*c*, which then turns the gears 1260*b*, which then rotates the cam 1260*a*, which triggers the mister 114' to release fluid from the reservoir 1144*b*. Another button 1144*g* may also be activated to initiate operation of the blower 112 to pass air through the chamber 116'. As air flows through the cleaning chamber 116' and mist is released by the mister 114', the mist passes into the cleaning chamber 116' and swirled about the dental appliance 102.

Figure 13:
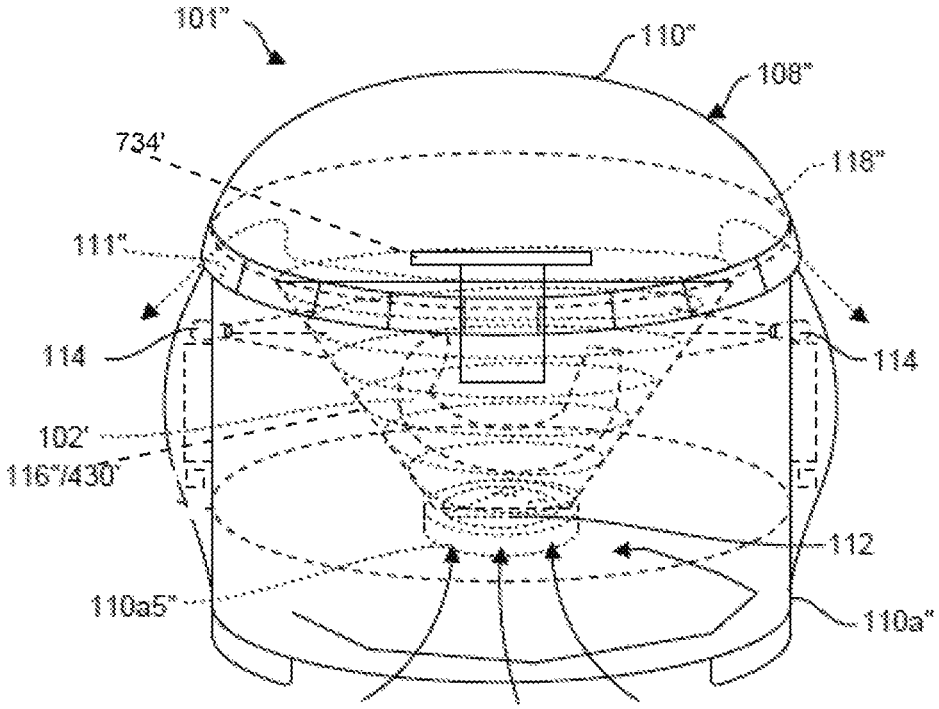
FIG. 13 is a perspective view of another hygienic cleaner.

FIG. 13 shows another embodiment of the hygienic cleaner 101" for cleaning a dental appliance 102'. As shown in this example, the hygienic cleaner 101' may have a variety of shapes and options, such as the upright or vertical configuration of FIG. 1 or the wider version of FIG. 13. As also shown in this example, the hygienic cleaner 101" may have housing 108" with a lid 110" shaped to cover the opening 111" of the base 110*a*". The housing 108" includes the internal container 116" for receiving the dental appliance 102', and the bottom 110*a*5" for supporting the container 116".

The lid 110" may close about an upper end of the base 110*a*" in a contact, snap, interference fit, or other engagement. A periphery of the lid 110" may have apertures 118" therethrough that act as the outlets for releasing the air from the housing 108". As in the hygienic cleaner 101 of FIG. 1, air flow may pass from the blower 112 through the cleaning chamber 116 and out the apertures 118" along a one-way flow path as indicated by the dashed lines.

The hygienic cleaner 101" may also have a variety of features. In the example of FIG. 13, the lid 110*b*" may be a flip top lid 110*b*" on a hinge, multiple misters 114, and apertures 118" along a periphery of the lid 110*b*". The multiple misters 114 may be used to spray multiple fluids, such as a cleaner and a mint flavor, onto the dental appliance 102'. As also shown in FIG. 13, the housing 108" may have the cleaning chamber 116"/430*c*" therein shaped to receive one or more dental appliances 102' of various shapes, such as retainers, dentures, mouth guards, etc. The blower 112 may be driven by a motor that also rotates the bottom 110*a*5", the container 116", and the dental appliance therein. The rotation may be a 360 degree or partial (e.g., 108 degree) rotation.

Components of the hygienic cleaner 101" (as well as other described herein) may optionally be removable for replacement and/or cleaning. These components may be removed for sterilization and/or for input into a dishwasher for cleaning.

Figure 14A:
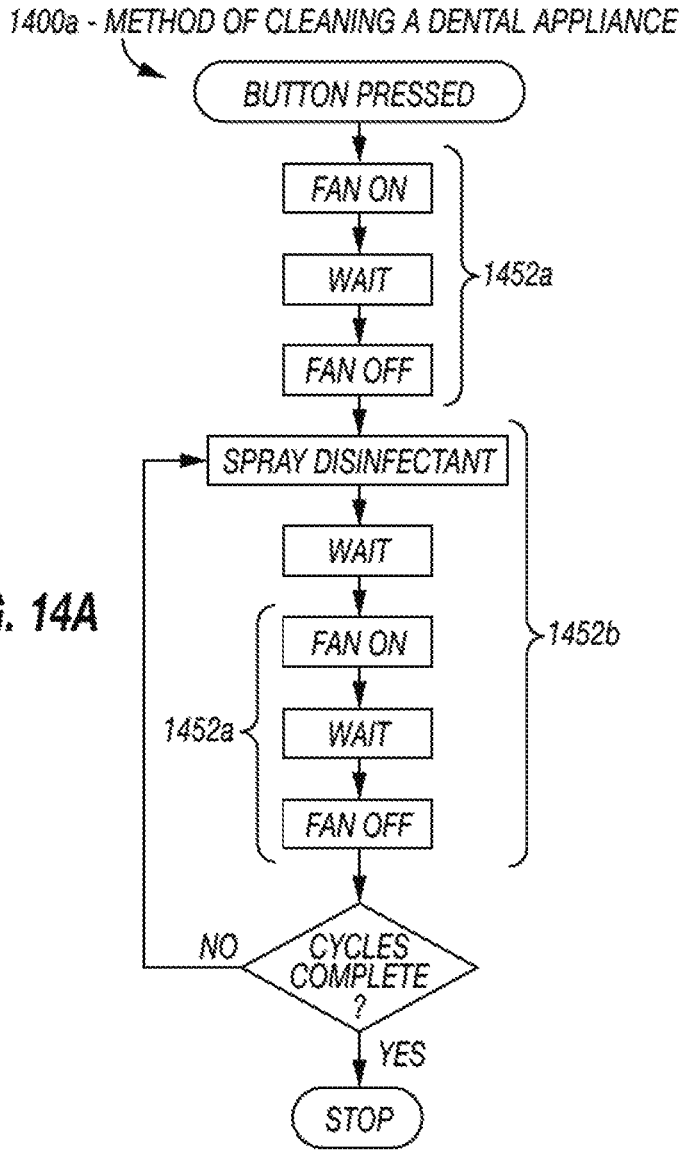
FIGS. 14A and 14B are flow charts depicting methods of cleaning a dental appliance.
Figure 14B:
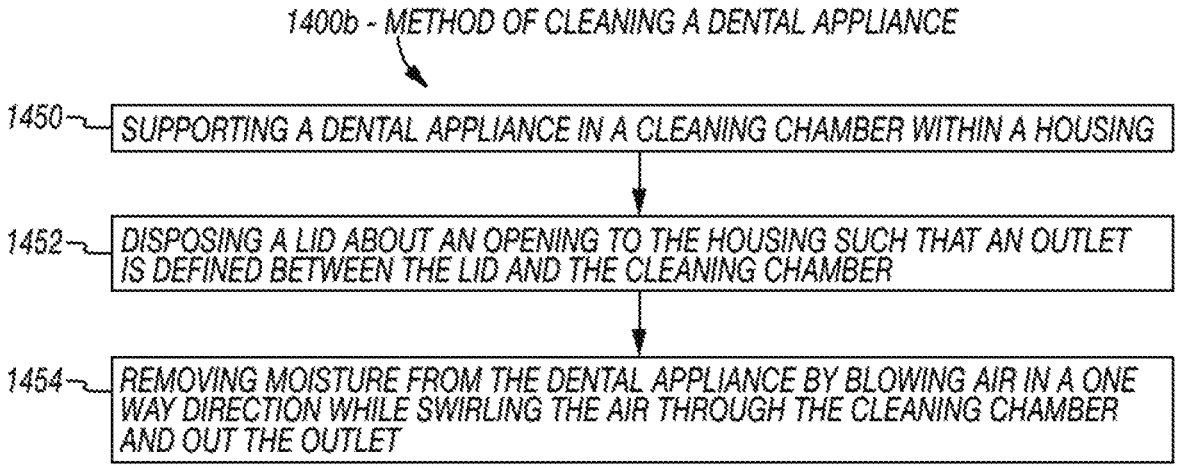

FIGS. 14A and 14B show methods 1400*a,b* of cleaning the dental appliance 102. As shown in FIG. 14A, the method 1400*a* may involve cycling the dental appliance 102 through a drying cycle 1452*a* and a disinfecting (or cleaning) cycle 1452*b*. The method 1400*a* starts by activating the hygienic cleaner, for example, by pressing a button. The drying cycle 1452*a* starts by turning on the fan of the motor for a wait time to flow air through the container and dry the dental appliance. Once completed, the fan turns off.

The method 1400*a* continues with the disinfectant cycle 1452*b*. This disinfectant cycle 1452*b* may automatically start after the drying cycle 1452*a*, or be activated by selection or manual activation (e.g., pushing the button again). The disinfectant cycle 1452*b* involves activating the mister 114 to spray the disinfectant and after a wait time repeating the drying cycle 1452*a*. Part or all of the process may be repeated for one or more cycles before the process is stopped.

As shown in FIG. 14B, the method 1400*b* may involve 1450 supporting a dental appliance in an inner chamber of a housing (e.g., in container 430*c* of FIG. 1), 1452 disposing a lid about an opening to the housing (e.g., lid 110*b* over inlet 111 of FIG. 1) such that an outlet is defined between the lid and the cleaning chamber, and 1454 removing moisture from the dental appliance by blowing air in a one-way direction while swirling the air through the cleaning chamber and out the outlet (e.g., out outlet 118 of FIG. 1).

One or more portions of one or more of the methods 1400*a,b* may be performed, combined, and/or repeated as desired.

Certain terms are used throughout the description and claims to refer to particular system components and configurations. As one skilled in the art will appreciate, the same component may be referred to by different names. This document does not intend to distinguish between components that differ in name but not function. In the following discussion and in the claims, the terms "including" and "comprising" are used in an open-ended fashion, and thus should be interpreted to mean "including, but not limited to . . . ."

The foregoing description of the figures is provided for the convenience of the reader. It should be understood, however, that the embodiments are not limited to the precise arrangements and configurations shown in the figures. Also, the figures are not necessarily drawn to scale, and certain features may be shown exaggerated in scale or in generalized or schematic form, in the interest of clarity and conciseness. Relatedly, certain features may be omitted in certain figures, and this may not be explicitly noted in all cases.

While various embodiments are described herein, it should be appreciated that the present disclosure encompasses many inventive concepts that may be embodied in a wide variety of contexts. Thus, the following detailed description of exemplary embodiments, read in conjunction with the accompanying drawings, is merely illustrative and is not to be taken as limiting the scope of the invention. Rather, the scope of the invention is defined by the appended claims and equivalents thereof.

In light of the principles and example embodiments described and illustrated herein, it will be recognized that the example embodiments can be modified in arrangement and detail without departing from such principles. Also, the foregoing discussion has focused on particular embodiments, but other configurations are also contemplated. In particular, even though expressions such as "in one embodiment," "in another embodiment," or the like are used herein, these phrases are meant to generally reference embodiment possibilities, and are not intended to limit the invention to particular embodiment configurations. As used herein, these terms may reference the same or different embodiments that are combinable into other embodiments. As a rule, any embodiment referenced herein is freely combinable with any one or more of the other embodiments referenced herein, and any number of features of different embodiments are combinable with one another, unless indicated otherwise or so dictated by the description herein.

Similarly, although example methods or processes have been described with regard to particular steps or operations performed in a particular sequence, numerous modifications could be applied to those methods or processes to derive numerous alternative embodiments of the present invention. For example, alternative embodiments may include methods or processes that use fewer than all of the disclosed steps or operations, methods or processes that use additional steps or operations, and methods or processes in which the individual steps or operations disclosed herein are combined, subdivided, rearranged, or otherwise altered. Similarly, this disclosure describes one or more embodiments wherein various operations are performed by certain systems, applications, module, components, etc. In alternative embodiments, however, those operations could be performed by different components.

Illustrative embodiments of the invention are described below. In the interest of clarity, not all features of an actual implementation are necessarily described for each embodiment disclosed in this specification. In the development of any such actual embodiment, numerous implementation-specific decisions must be made to achieve the design-specific goals, which will vary from one implementation to another. It will be appreciated that such a development effort, while possibly complex and time-consuming, would nevertheless be a routine undertaking for persons of ordinary skill in the art having the benefit of this disclosure.

The above description is illustrative of the preferred embodiment and many modifications may be made by those skilled in the art without departing from the disclosure whose scope is to be determined from the literal and equivalent scope of the claims that follow.

While the embodiments are described with reference to various implementations and exploitations, it will be understood that these embodiments are illustrative and that the scope of the inventive subject matter is not limited to them. Many variations, modifications, additions and improvements are possible, such as various combinations of the features and/or methods described herein.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A hygienic cleaner for cleaning a dental appliance, the hygienic cleaner comprising:

a housing comprising a base and a lid, the lid positionable about an inlet to the base;

a cleaning chamber comprising a tube positioned in the base and a perforated vent connected to the tube, the tube shaped to receive the dental appliance therein, the perforated vent extending into in the lid to define an outlet between the lid and the perforated vent;

a blower comprising a fan to blow air through the tube, through the perforated vent, and out the outlet whereby moisture on the dental appliance is blown out of the housing; and a mister comprising a sprayer positionable about the cleaning chamber to emit a cleaning fluid onto the dental appliance in the cleaning chamber whereby contaminants on the dental appliance are destroyed.

2. The hygienic cleaner of claim 1, wherein the blower further comprises a stator with curved blades to swirl the air as it passes through the tube.

3. The hygienic cleaner of claim 1, wherein the perforations of the perforated vent are fluidly connected to an upper end of the cleaning chamber.

4. The hygienic cleaner of claim 1, wherein a one-way flow path is defined from the blower through the cleaning chamber, and out the outlet.

5. The hygienic cleaner of claim 1, wherein the cleaning chamber further comprises a ring, a container, and an end.

6. The hygienic cleaner of claim 5, wherein the container is connected to an upper end of the housing by the ring and to a bottom of the housing by the end.

7. The hygienic cleaner of claim 1, wherein the housing comprises side portions and a bottom.

8. The hygienic cleaner of claim 7, wherein the blower is supported on the bottom and extends into a lower end of the cleaning chamber.

9. The hygienic cleaner of claim 1, wherein the mister further comprises a reservoir and a cleaning fluid, the sprayer positioned about the cleaning chamber to spray the cleaning fluid from the reservoir onto the dental appliance.

10. The hygienic cleaner of claim 9, wherein the sprayer comprises one of an atomizer, an aerosol, and combinations thereof.

11. The hygienic cleaner of claim 9, wherein the mister further comprises a trigger assembly, the trigger assembly comprising a motor, gears, and a cam.

12. The hygienic cleaner of claim 1, further comprising a UV light positionable about the cleaning chamber, the UV light positioned to emit UV rays onto the dental appliance.

13. The hygienic cleaner of claim 1, further comprising a support arm positioned about the cleaning chamber to support the dental appliance in the cleaning chamber.

14. The hygienic cleaner of claim 1, further comprising a filter positioned about the cleaning chamber for filtering the air to be blown by the blower.

15. The hygienic cleaner of claim 1, further comprising a drawer positioned about the base to collect drainage from the cleaning chamber.

16. The hygienic cleaner of claim 1, further comprising electronics to selectively operate one of the blower, the mister, and combinations thereof.

17. The hygienic cleaner of claim 16, wherein the electronics comprise at least one of a power supply, a sensor, a database, a transceiver, a clock, and combinations thereof.

* * * * *